US007967704B2

(12) United States Patent
Schulte

(10) Patent No.: US 7,967,704 B2
(45) Date of Patent: Jun. 28, 2011

(54) RECONFIGURABLE IMPLEMENT POSITIONER AND GUIDANCE SYSTEM

(75) Inventor: Anthony G. Schulte, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 199 days.

(21) Appl. No.: 12/241,148

(22) Filed: Sep. 30, 2008

(65) Prior Publication Data

US 2010/0081522 A1 Apr. 1, 2010

(51) Int. Cl.
*A63B 69/00* (2006.01)
*A63B 69/36* (2006.01)

(52) U.S. Cl. ..... 473/417; 473/422

(58) Field of Classification Search ..... 473/417, 473/418, 422, 419, 423, 429, 431, 451, 454, 473/453; D21/715–719; 482/87, 90, 160
See application file for complete search history.

(56) References Cited

U.S. PATENT DOCUMENTS

| | | | | |
|---|---|---|---|---|
| 2,884,250 | A * | 4/1959 | Patterson | 473/423 |
| 3,039,770 | A | 6/1962 | Ferretti | |
| 3,819,038 | A | 6/1974 | Candor et al. | |
| 3,874,662 | A * | 4/1975 | Harrington | 473/417 |
| 3,877,697 | A * | 4/1975 | Lersch | 473/417 |
| 4,136,869 | A | 1/1979 | Tassone | |
| 4,176,838 | A | 12/1979 | Griffin | |
| 4,364,563 | A * | 12/1982 | Stafford | 473/417 |
| 4,830,371 | A | 5/1989 | Lay | |
| 4,854,587 | A | 8/1989 | Groves | |
| 4,901,998 | A | 2/1990 | Griffith | |
| 4,938,478 | A | 7/1990 | Lay | |
| 4,976,431 | A | 12/1990 | Guenther | |
| 4,979,741 | A * | 12/1990 | Butcher | 473/417 |
| 5,393,050 | A | 2/1995 | Lloyd | |
| 6,045,462 | A | 4/2000 | Mourek | |
| 6,461,255 | B1 * | 10/2002 | Smith | 473/417 |
| 6,551,204 | B1 | 4/2003 | Di Re | |
| 6,612,943 | B2 | 9/2003 | Beers | |
| 6,616,554 | B2 * | 9/2003 | Liao | 473/417 |
| 7,070,520 | B1 | 7/2006 | An | |
| 7,204,769 | B2 | 4/2007 | Bandimere et al. | |

(Continued)

OTHER PUBLICATIONS

Louisville Instructo-Swing 1500 Swing Youth Baseball Batting Trainer; http://www.sportsworldwholesalers.com/loin15swyoba.html, dated Sep. 29, 2008.

*Primary Examiner* — Mitra Aryanpour
(74) *Attorney, Agent, or Firm* — Edell, Shapiro & Finnan, LLC

(57) ABSTRACT

The present invention relates to a reconfigurable implement positioning and guidance system. The system includes an implement (e.g., a ball), an implement support, and a swung object (e.g., a bat). The implement support is reconfigurable between two modes. In a first mode the implement can be struck and propelled from the implement support and in a second mode the implement is fastened to the implement support so that it cannot separate upon impact with the swung object. The system also includes a guide positioned in the vicinity (e.g., below) of the implement so that an object swung below the implement will contact the guide which will direct the swung object toward and into contact with the implement. The guide can be employed in the first mode or the system can be used in either mode with the guide removed.

19 Claims, 11 Drawing Sheets

U.S. PATENT DOCUMENTS

| | | | | |
|---|---|---|---|---|
| 2004/0214664 | A1 | 10/2004 | Marra et al. | |
| 2005/0202906 | A1 | 9/2005 | Leal et al. | |
| 2006/0035729 | A1 | 2/2006 | Wang | |
| 2007/0049426 | A1 | 3/2007 | Huang | |
| 2007/0054756 | A1 | 3/2007 | Hanson et al. | |
| 2007/0072703 | A1* | 3/2007 | James | 473/417 |
| 2009/0029803 | A1* | 1/2009 | Lincoln | 473/417 |
| 2009/0082140 | A1* | 3/2009 | Liao | 473/417 |

* cited by examiner

RECONFIGURABLE IMPLEMENT POSITIONER AND GUIDANCE SYSTEM

FIELD OF THE INVENTION

The present invention relates to a reconfigurable implement positioning and guidance system or device including an implement support for positioning an implement and a guide for guiding a striker (e.g., a bat or another object to be swung) toward the implement (e.g., a ball). In particular, the present invention relates to an implement support for supporting an implement in a striking position, the implement support including a guide which when contacted by a swung striker, directs or deflects the striker toward and into contact with the implement.

BACKGROUND OF THE INVENTION

Several popular sporting activities (e.g., baseball, softball, t-ball, cricket, hockey, etc.) involve swinging a striker (e.g., a bat or other object to be swung) to hit an implement (e.g., a ball). Parents want to involve children in such sporting activities because consistent successful swinging of a striker and making contact with a ball requires significant hand-eye coordination. However, young children do not always have adequate hand-eye coordination. Consequently, some children can be frustrated when participating in these sporting activities if they cannot consistently make contact with the ball.

Typically, children fail to make contact with the implement by swinging the striker slightly above the implement (e.g., a high swing) or slightly below the implement (e.g., a low swing). It would therefore be helpful to develop a device that modifies a less than perfect swing (e.g., high swing or low swing) so that these swings still result in a successful contact between the striker and the implement. Specifically, it would be helpful to develop a device that contacts and guides a low swung or high swung striker and directs the striker toward the implement.

SUMMARY OF THE INVENTION

The present invention relates to a reconfigurable implement positioning and guidance system. The system includes an implement support for supporting an implement above a play surface (e.g., the ground or floor). The implement is supported in a contact position or striking position and includes a guidance system for directing a striker toward the implement. The implement support includes a positioning member. The positioning member includes an upper end and a lower end. An implement seat is positioned at an upper end of the positioning member. At the lower end of the positioning member is a base and in one embodiment, the base pivotally supports the positioning member. In addition, the guidance system is connected to the implement seat. The guidance system includes a guide member and the guide member includes a guide surface. A first portion of the guide surface extends below the implement seat and a second portion of the guide surface extends above the implement seat. When an implement is placed on the implement seat, it is supported above the play surface in a striking position ready to be struck by a striker.

The implement seat accommodates two different types of implements that facilitate operation of the system in two separate respective modes. A first implement is spherical in shape and rests, unsecured, on the implement seat when it is in the striking position. A second implement includes a spherical portion similar to that of the first implement. However, the second implement includes a coupling mechanism, such as a threaded extension projecting from the spherical portion. This second implement may be secured to the implement seat by the coupling mechanism when it is in the striking position. In the first, unsecured mode, the first spherical implement is positioned in the striking position by simply resting the first implement on the implement seat. In the second, secured mode, the coupling mechanism of the second implement is attached to the implement seat (e.g., the threaded extension of the second implement is threadably received in a female receiver of the implement seat). Therefore, in the first, unsecured mode, when a striker makes contact with an implement, the implement is propelled away from the implement support. In contrast, in the second, secured mode, the implement remains secured to the implement seat when a striker contacts the implement. Because the implement seat may pivot relative to the base, in the first and second secured modes, the positioning member absorbs the impact of the striker by pivoting away from the striker as the implement is struck.

As mentioned above, the guide surface may extend above and below the implement seat. Consequently, in the striking position, in both the first and second modes, a swung striker that contacts the guide surface also directs the striker toward and into contact with the implement. The guide is selectively removable and can be removed for a player who has developed sufficient hand-eye coordination and no longer requires its assistance.

BRIEF DESCRIPTION OF THE DRAWINGS

Like reference numerals have been used to identify like elements throughout this disclosure.

DETAILED DESCRIPTION OF THE INVENTION

The present invention relates to a reconfigurable implement positioning and guidance system. The reconfigurable implement positioning and guidance system includes an implement support that positions an implement in a striking position above a support surface. In addition, the implement support includes a guide positioned in proximity to the implement. The guide contacts and redirects a striker (e.g., a bat, hockey stick, etc.), that is swung too high or too low, back in the direction of the implement.

The terms "reconfigurable implement positioning and guidance system," "batting tee," and "device" may be used interchangeably herein. The terms "guide device" and "guide system" may be used interchangeably. The terms "connector" and "coupling mechanism" may be used interchangeably. In addition, the terms "play implement," "implement," and "ball" may be used interchangeably herein. The terms "positioning member," "support," "support member," and "pedestal" may be used interchangeably herein. The terms "bat," "object," "swung object," and "striker" may also be used interchangeably herein. The terms "base," and "base member" may also be used interchangeably herein. Finally, the term "seat" may be used interchangeably with the term "implement seat", and the term "support surface" may be used interchangeably with the term "play surface."

Figure 1:
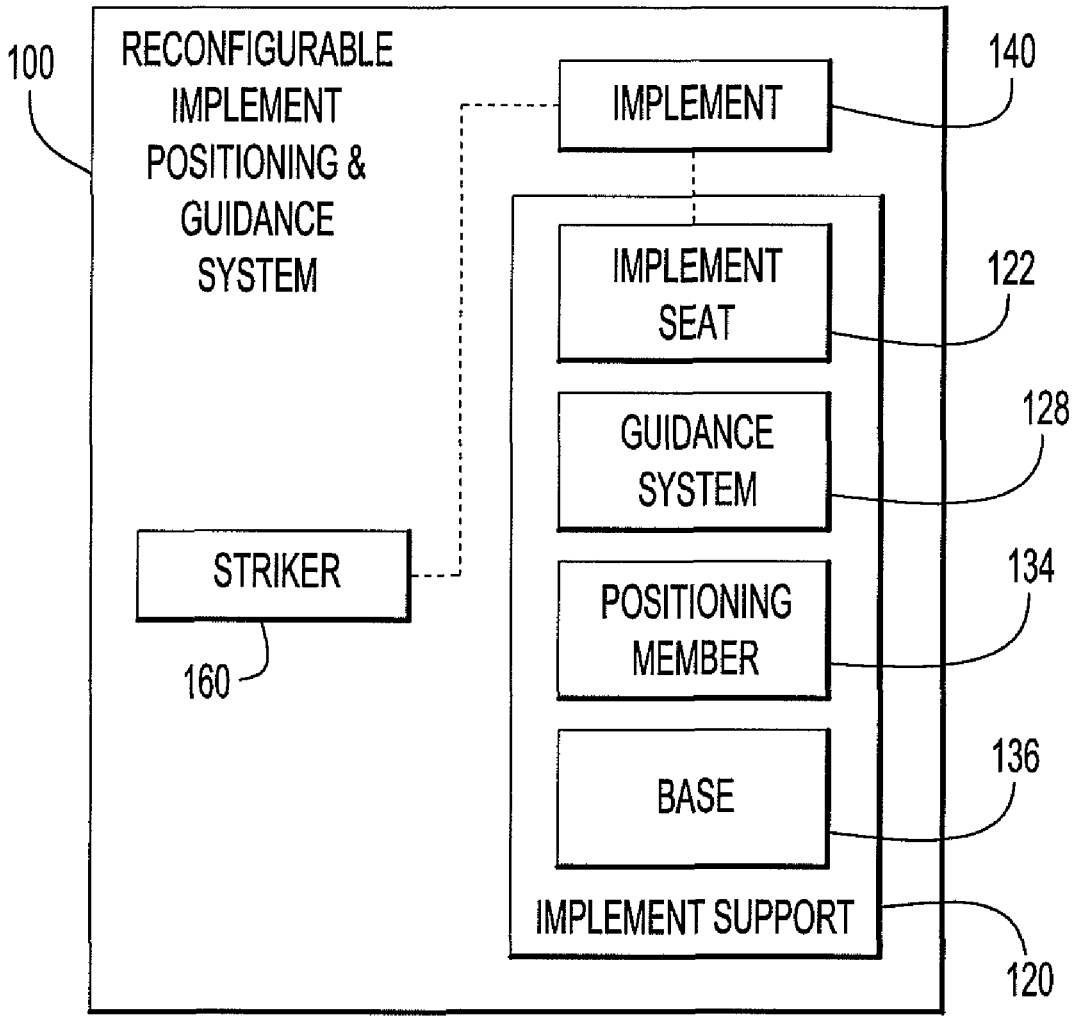
FIGS. 1 and 2 illustrate schematic block diagrams of an embodiment of the reconfigurable implement positioning and guidance system of the present invention.

FIG. 1 shows a block diagram illustrating the inventive concept in accordance with the present invention. In a basic form, the present invention includes a reconfigurable infant positioning and guidance system 100 including an implement support 120, an implement 140 (e.g., ball, puck, etc.), and a striker (e.g., a bat, hockey stick, or other swung object). Implement support 120 includes a positioning member 134, a base 136, an implement seat 122 and a guidance system 128. Positioning member 120 also has a first end and a second end. The first end of the positioning member 134 is pivotally connected base 136. The pivotal connection is also biased so that positioning member 134 has a ready position and a pivoted position. A biasing member pivots positioning member 134 back into the ready position whenever it is displaced into the pivoted position.

Implement seat 122 is located at the second end of positioning member 134. When positioning member 134 is in the ready position, and implement 140 is positioned on implement seat 122, implement support 134 positions implement 140 in the striking position to be struck by a user. Guidance system 128 is connected in proximity to implement seat 122 and includes a guide. When striker 160 is inaccurately swung (e.g., below) toward implement 140, striker 160 contacts the guide which then directs, redirects, or guides striker 160 toward contact with implement 140.

Figure 2:
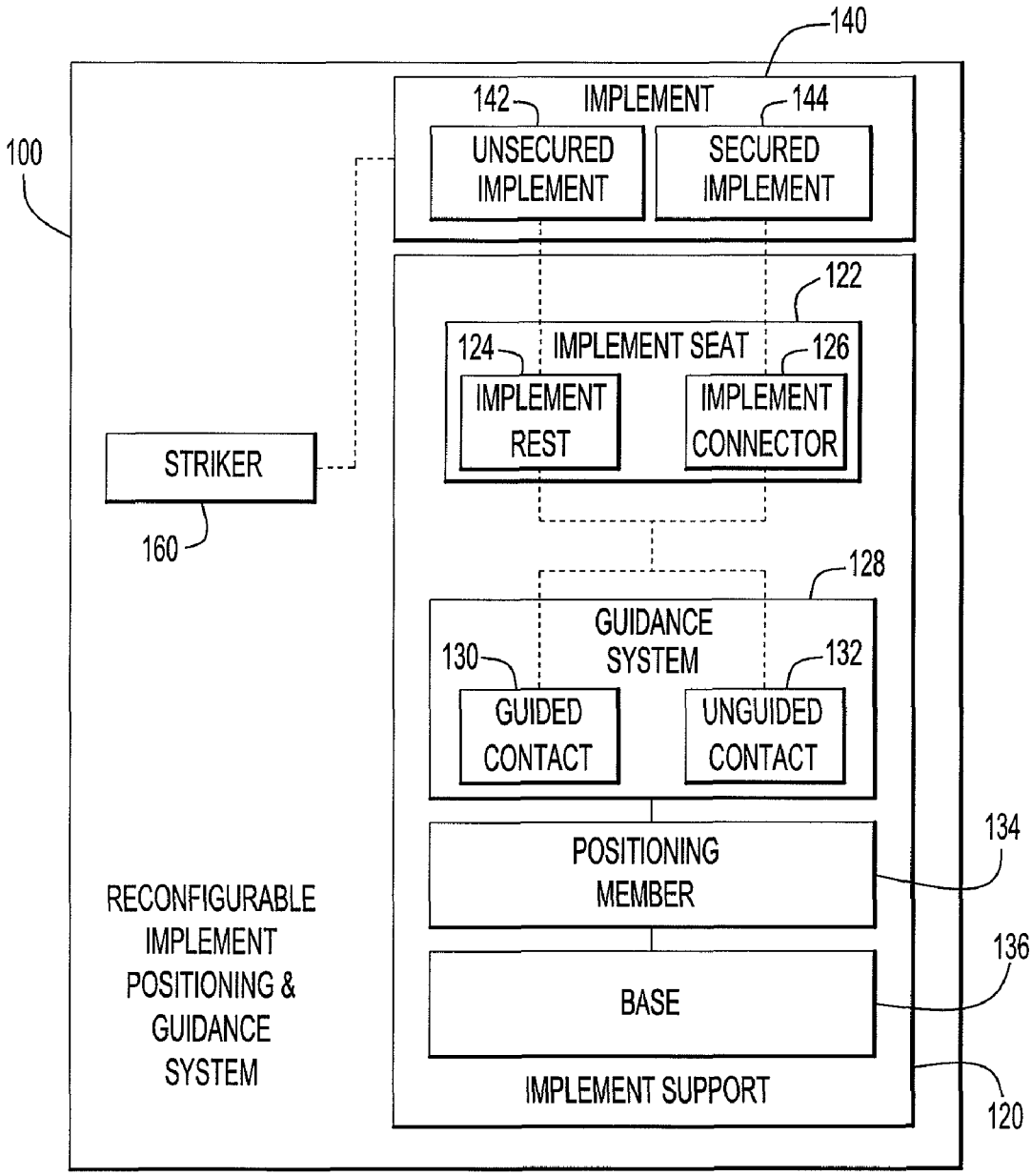

FIG. 2 shows a slightly more detailed a block diagram of the conceptual illustration in accordance with the present invention. In FIG. 2, the illustration of reconfigurable implement positioning and guidance system 100 is expanded such that implement 140 can be one of an unsecured implement 142 and a secured implement 144. In addition, FIG. 2 expands implement seat 122, describing it as either an implement rest 124 or an implement connector 126. Implement rest 124 is a surface on which unsecured implement 142 rests in an unrestrained manner. On the other hand, implement connector 126, includes coupling mechanism that cooperates with a corresponding coupling mechanism on secured implement 144 to connect secured implement 144 to implement connector 126. Finally, guidance system 128 is expanded to highlight that the guide can be included to provide guided contact or can be removed for play by users who do not require such assistance. In other words, the guidance system 128 can be removed for children who have developed sufficient hand-eye coordination and who have outgrown the need for the additional assistance.

Figure 3:
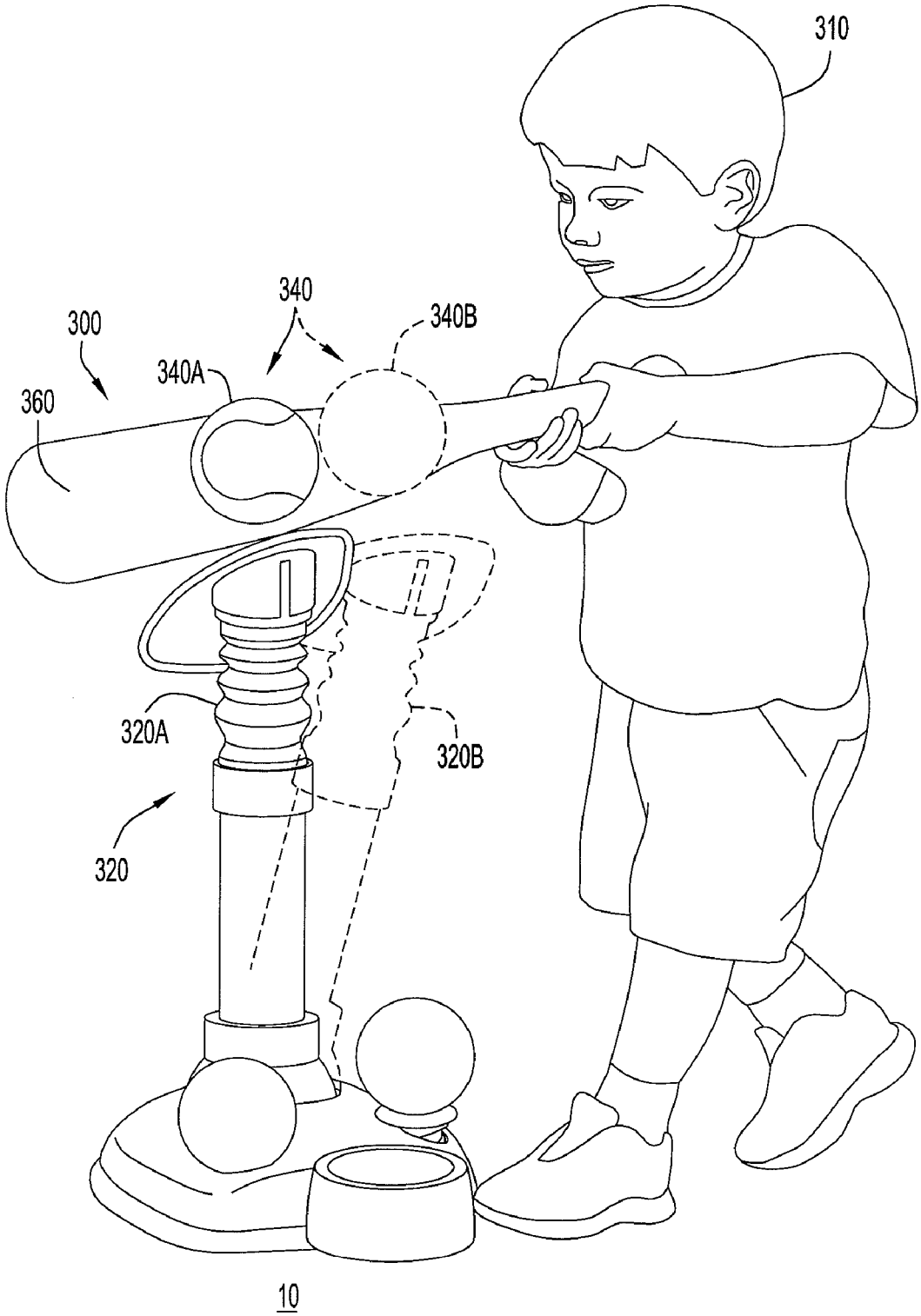
FIG. 3 illustrates a perspective view of an embodiment of the reconfigurable implement positioning and guidance system of the present invention showing a child using the system.

FIG. 3 illustrates a perspective view of a child 310 playing with an embodiment of the reconfigurable implement positioning and guidance system 300 in one mode of the system 300. Various system modes will be described below in greater detail. FIG. 3 illustrates the general use of the system 300.

The device includes an implement support 320 placed on a support surface 10. Implement 340 is placed on and supported by an upper portion of implement support 320. In the striking position, implement 340 is exposed on top of implement support 320 in an unrestrained manner. Child 300 swings a striker (such as bat 360) into contact with implement 340. In the mode illustrated in FIG. 3, implement 340 is propelled from implement support 320. Two positions of implement 340 are shown in sequence. Implement 340A is shown in an initial location in solid lines, while implement 340B is shown in dotted lines in a subsequent location (not that implement 340A is shown slightly above implement support 320A for illustrative purposes only—prior to being struck by bat 360, the implement 340A is in contact with the upper portion of implement support 320). Similarly, implement support 320 is shown in an initial position 320A before contact and in a subsequent position 320B after contact with bat 360. Implement support 320 is in a striking position in initial position 320A and in a pivoted position in subsequent position 320B.

Figure 4:
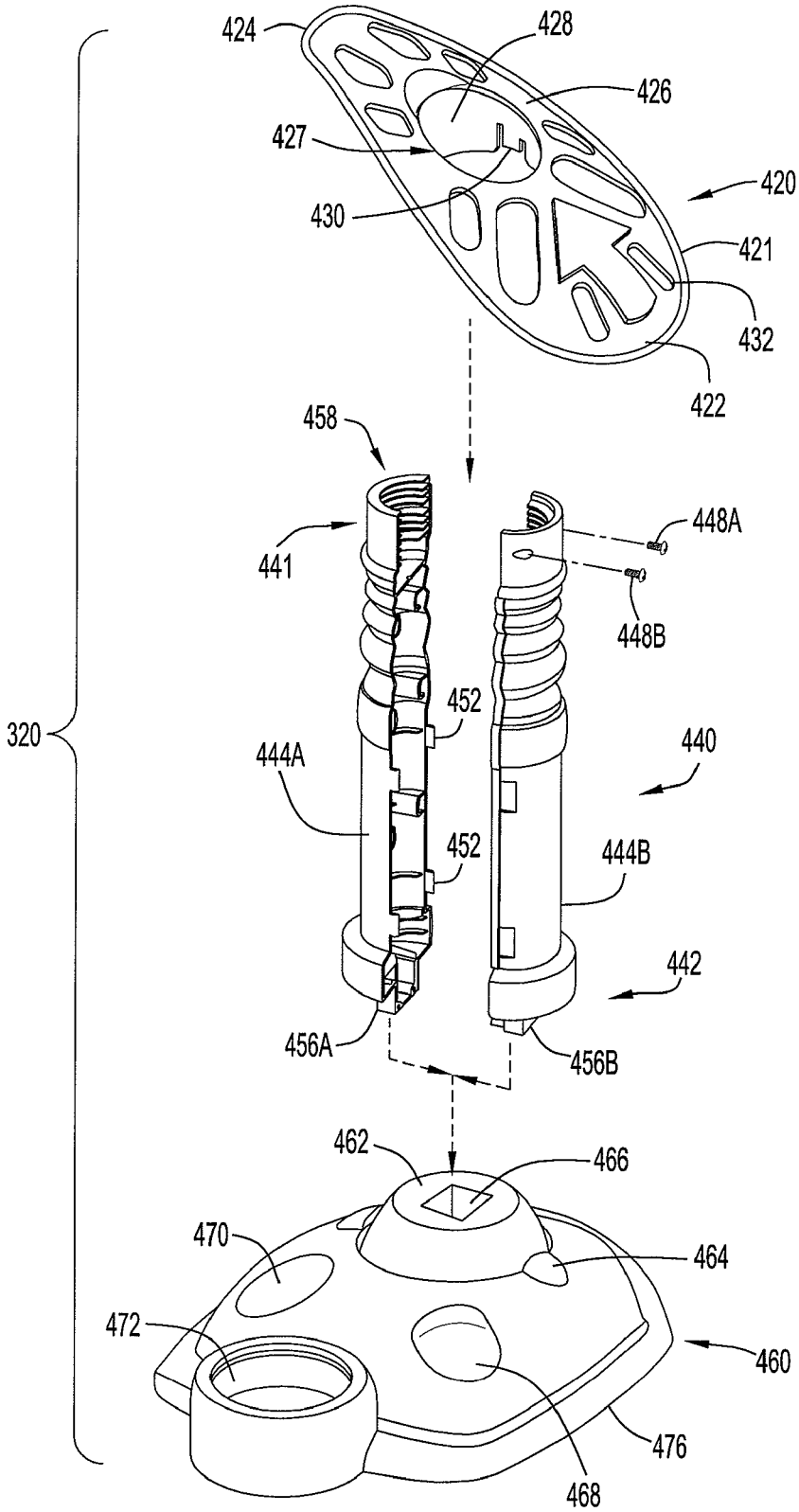
FIG. 4 illustrates an exploded perspective view of an implement support of the system of FIG. 3.

FIG. 4 illustrates an exploded view of and embodiment of the device 300. Implement support 320 includes a positioning member 440, a base 460, and a guide 420. Positioning member 440 is elongated and includes a first portion 444A that is connectable to a second portion 444B. First and second portions 444A and 444B include various tabs 452 and receivers (not shown) that interconnect with each other to fasten first portion 444A to second portion 444B. First portion 444A and second portion 444B may be further secured together by threaded fasteners 448A and 448B. Positioning member 440 also includes an upper end 441 and a lower end 442. Lower end 442 includes a first projection 456A on first portion 444A and a second projection 456B on second portion 444B. When first portion 444A and second portion 444B come together they form composite projection 456. Upper end 441 of the positioning member 440 includes an implement seat 458. Implement seat 458 is the portion of positioning member 440 that receives implements (such as implement 340).

Base 460 includes a lower surface 476 that can be disposed in contact with play surface 10. Base 460 also includes a pivot support 464 for pivotally supporting a pivotable receiver 462. Pivot support 464 includes an axle (not shown) about which pivotable receiver 462 rotates (i.e., when positioning member 440 is struck by a bat). Pivot support 464 also includes a biasing member (not shown) for biasing positioning member 440 back to the implement striking position (e.g., a vertical position) after being contacted by the bat. Pivotable receiver 462 includes an recess 466. Positioning member 440 is connected to base 460 by inserting composite projection 456 into recess 466. Finally base 460 includes implement recesses 468 and 470 for storing implements that are not being used. Base 460 also includes a striker recess or bat recess 472 for storing an object such as a bat 360 when the device 300 is not in use.

Guide 420 includes a guide body 421 having a guide surface 432. Guide surface 432 is disposed at an angle relative to a lower surface 476 of base 460. Guide body 421 is further defined by an upper portion 424 and a lower portion 422. Guide body 421 includes a connector 427. Connector 427 includes a guide opening 426 defined by a connector wall 428. Connector wall 428 includes slots that define locking tabs 430. Only one locking tab 430 is shown in the perspective of FIG. 4. However, multiple lock tabs 430 exist in connector wall 428 (see for example lock tabs 430A and 430B in FIGS. 6 and 7).

Figure 5:
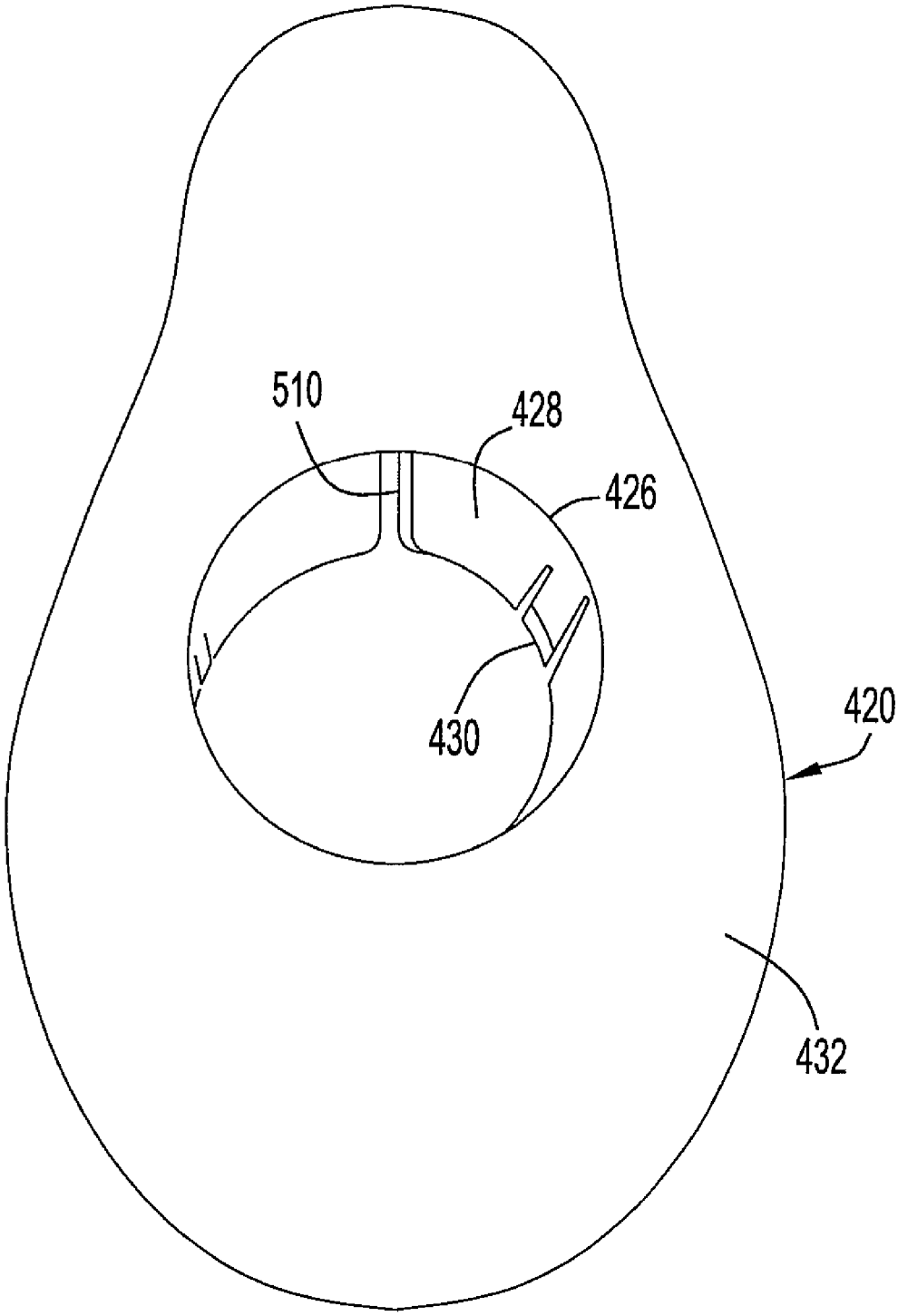
FIG. 5 illustrates a perspective view of the guide of the system of FIG. 3.
Figure 6:
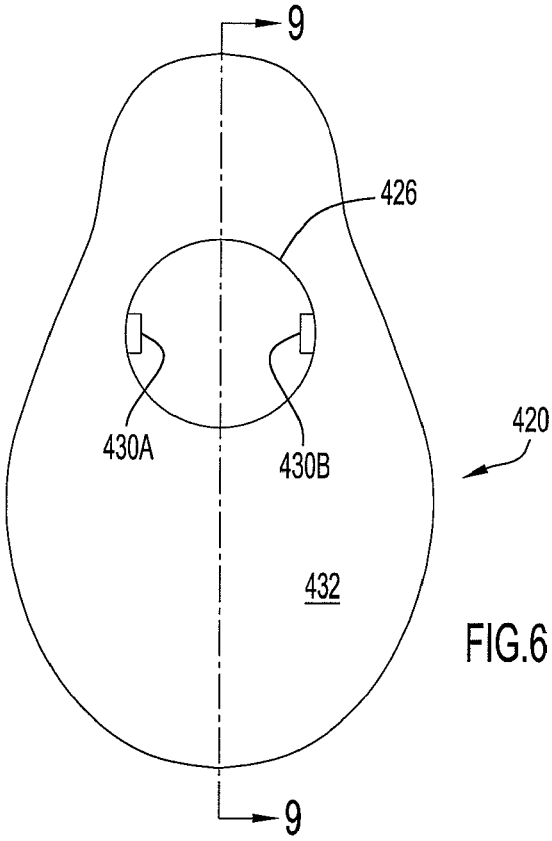
FIG. 6 illustrates a top view of the guide of FIG. 5.
Figure 7:
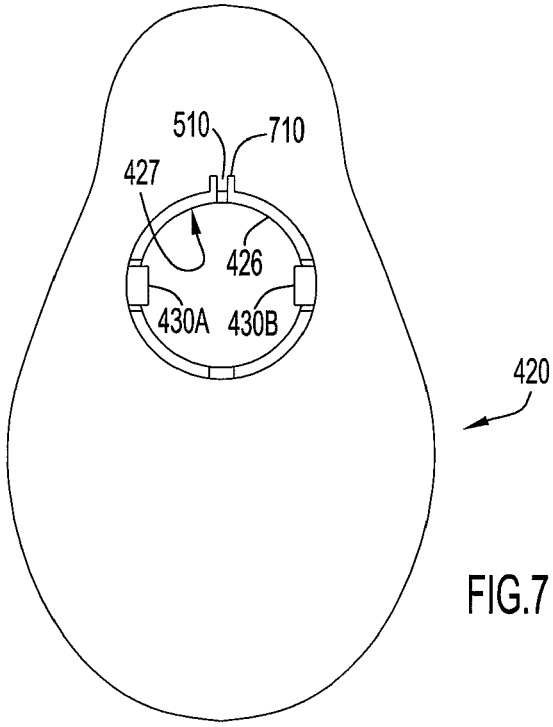
FIG. 7 illustrates a bottom view of the guide of FIG. 5.
Figure 8:
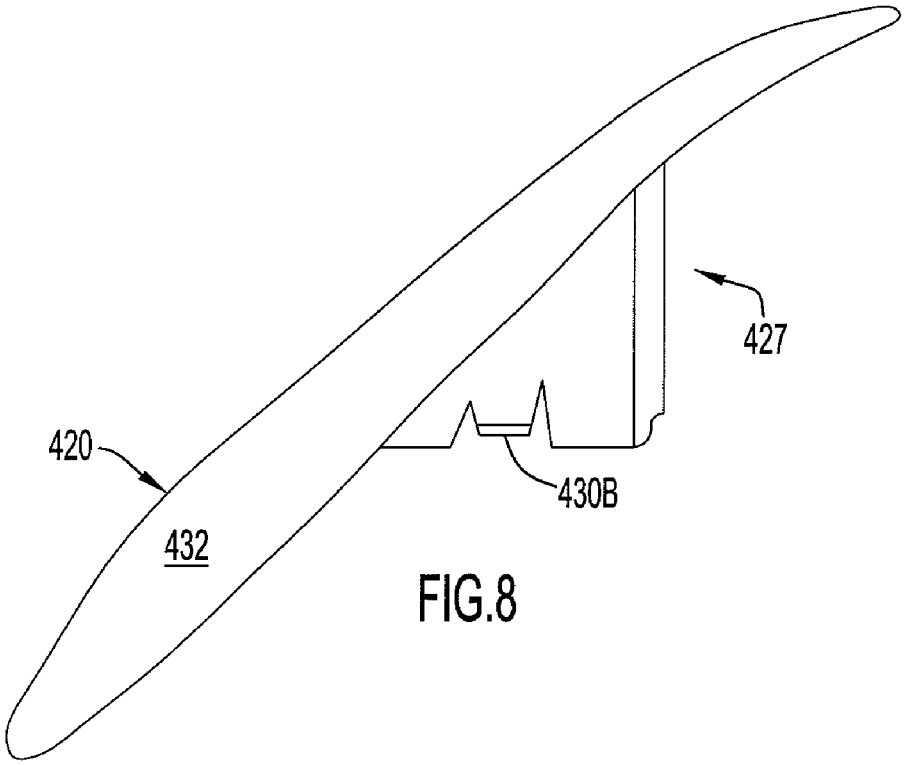
FIG. 8 illustrates a side view of the guide of FIG. 5.
Figure 9:
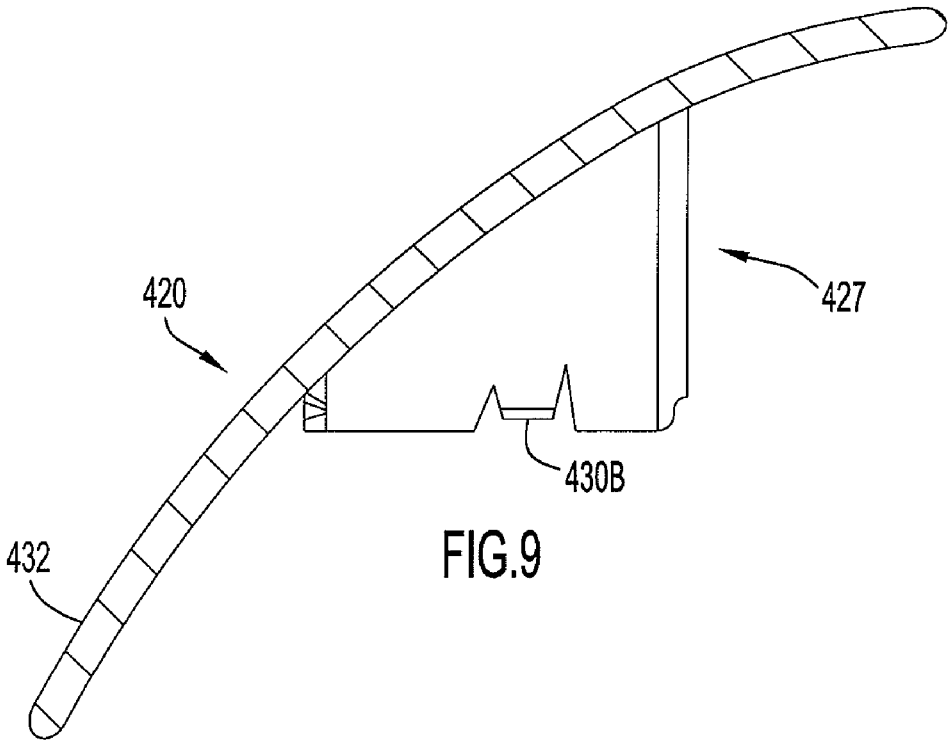
FIG. 9 illustrates a cross-sectional view of the guide of FIG. 5. taken along the section 9-9 of FIG. 6.

FIGS. 5-9 show the guide 420 in various views. FIG. 5 is a top perspective view, FIG. 6 is a top view, FIG. 7 is a bottom view, FIG. 8 is a side view, and FIG. 9 is a cross-sectional view. FIG. 5 shows an alignment slot 510 for ensuring that guide 420 is properly aligned on positioning member 440. In addition, FIG. 7 shows guide lips 710 extending along alignment slot 510. The manner in which alignment slot 510 aids in aligning guide 420 on positioning member 440 will be discussed in more detail below.

Figure 10:
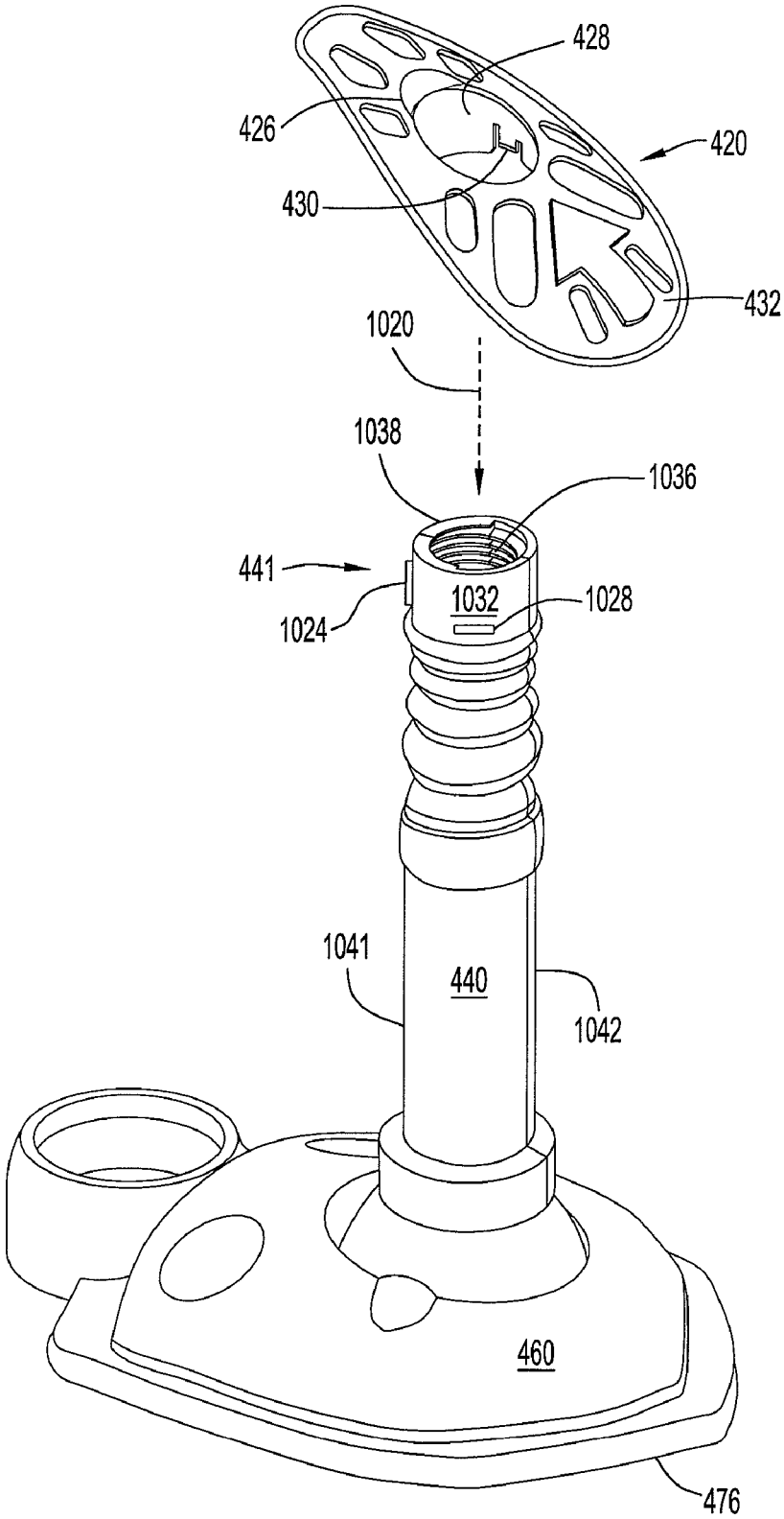
FIG. 10 illustrates a perspective view of the system of FIG. 3. showing the guide being connected to the implement support.

FIG. 10 illustrates the connection of guide 420 to upper end 441 of positioning member 440. Guide 420 is connected to positioning member 440 by sliding the inner side wall of connector wall 428 over the positioning wall 1032 of the positioning member 440 in the direction of arrow 1020. Locking tabs 430 are resilient so that they flex radially outward during insertion until they snap into slots 1028. At the same time, linear guide rib 1024 slides into alignment slot 510 on guide 420. The inter-engagement between guide rib 1024 and alignment slot 510 keys the positioning of the guide 420 on the positioning member 440 and prevents guide 420 from rotating about a longitudinal axis of positioning member 440. Implement seat 458 includes a threaded opening 1036 and an implement support ring 1038. Threaded opening 1036 extends through guide opening 426 when guide 420 is installed on positioning member 440. In addition, positioning member 440 can be separable into an upper member 1042 that telescopically slides over a lower member 1041 to adjust the distance between the implement seat 458 (including the implement support ring 1038) and the lower surface 476 of the base 460.

Figure 11:
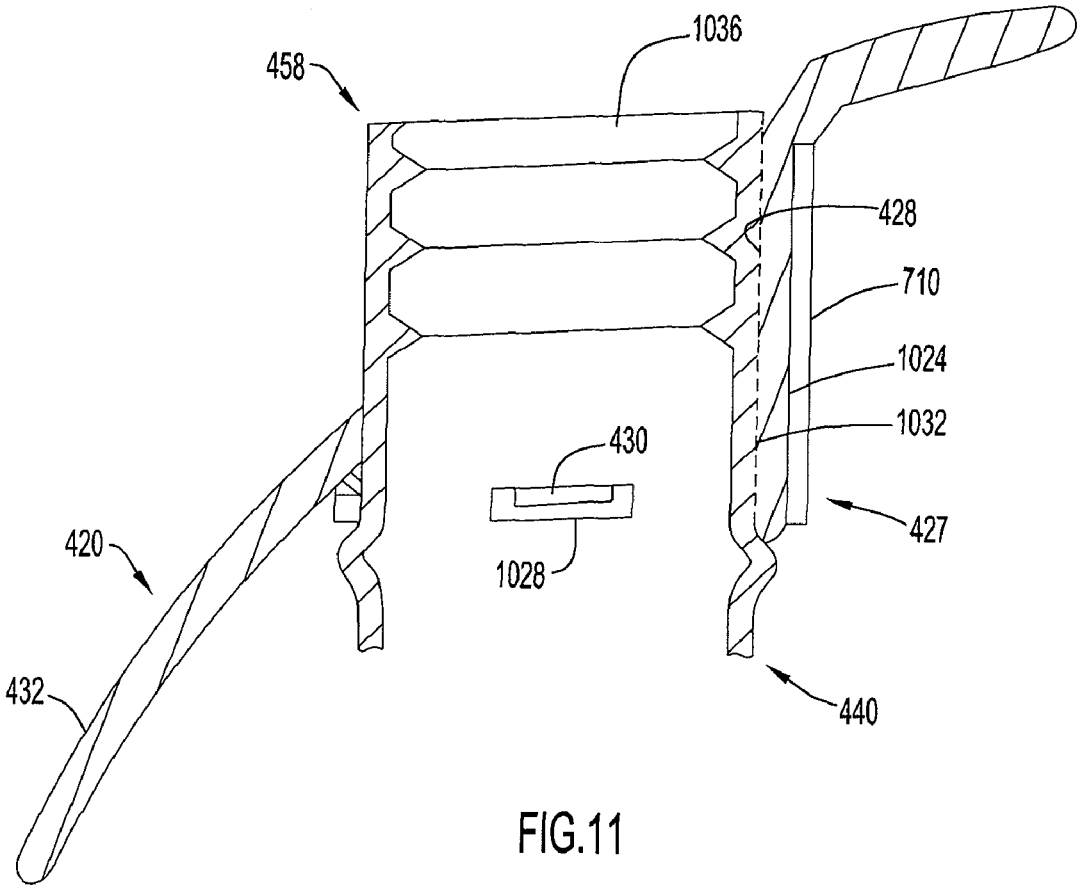
FIG. 11 illustrates a cross-sectional view of the guide of the FIG. 5 positioned on the implement support.

FIG. 11 is a cross sectional view of guide 420 connected to positioning member 440. The view shows locking tab 430 locked into slot 1028. As shown, the inner side wall of connector wall 428 overlaps the positioning wall 1032 of the positioning member 440. The view also shows guide rib 1024 trapped within guide lips 710 to prevent rotation of the guide 420 with respect to the positioning member 440 as discussed above. The view also shows threaded opening 1036 and the implement seat 458 extending through guide opening 426 and through guide surface 432.

Figure 12:
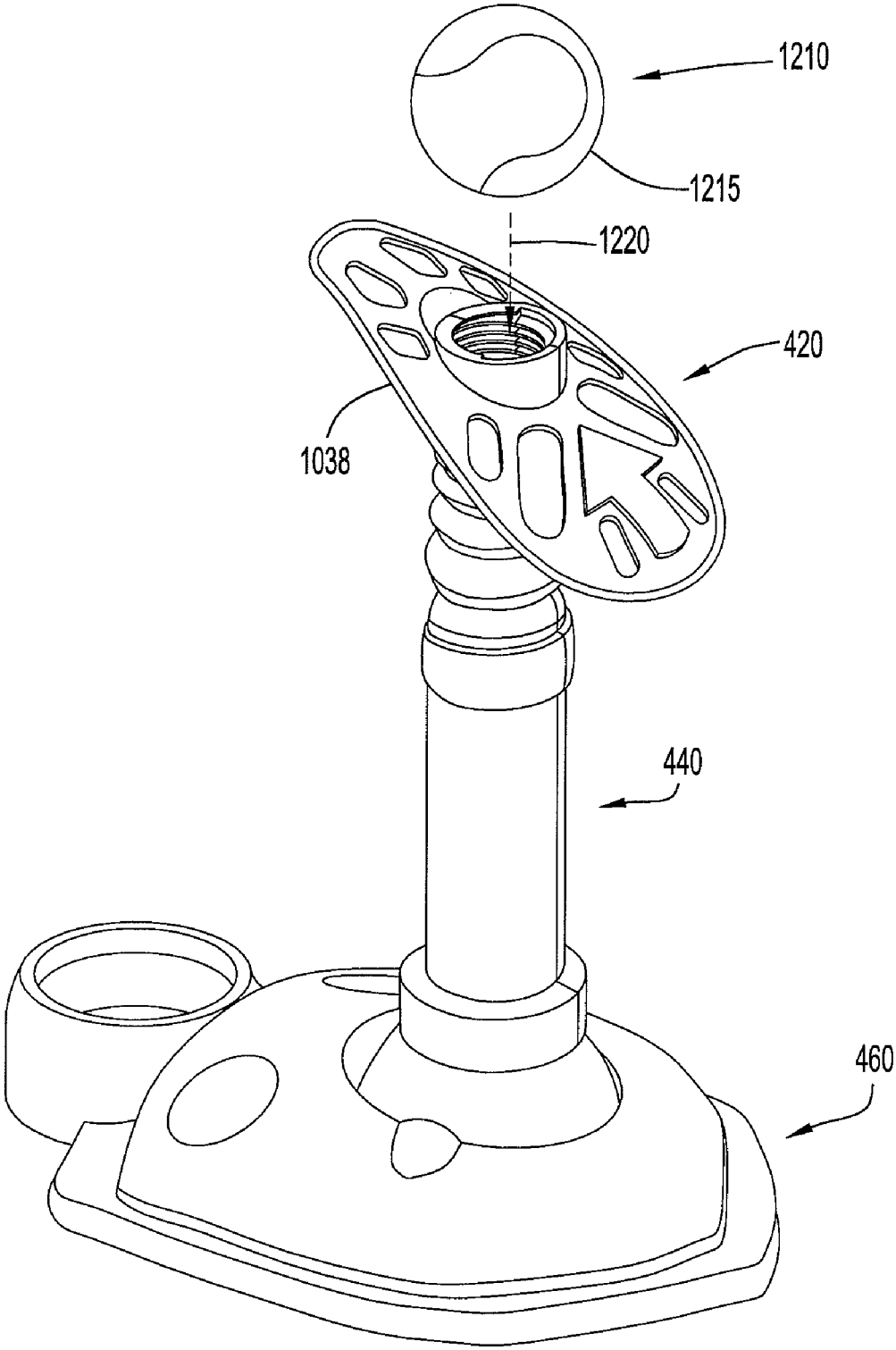
FIG. 12 illustrates a perspective view of the system of FIG. 3. showing a first type of implement being positioned on the implement seat.
Figure 13:
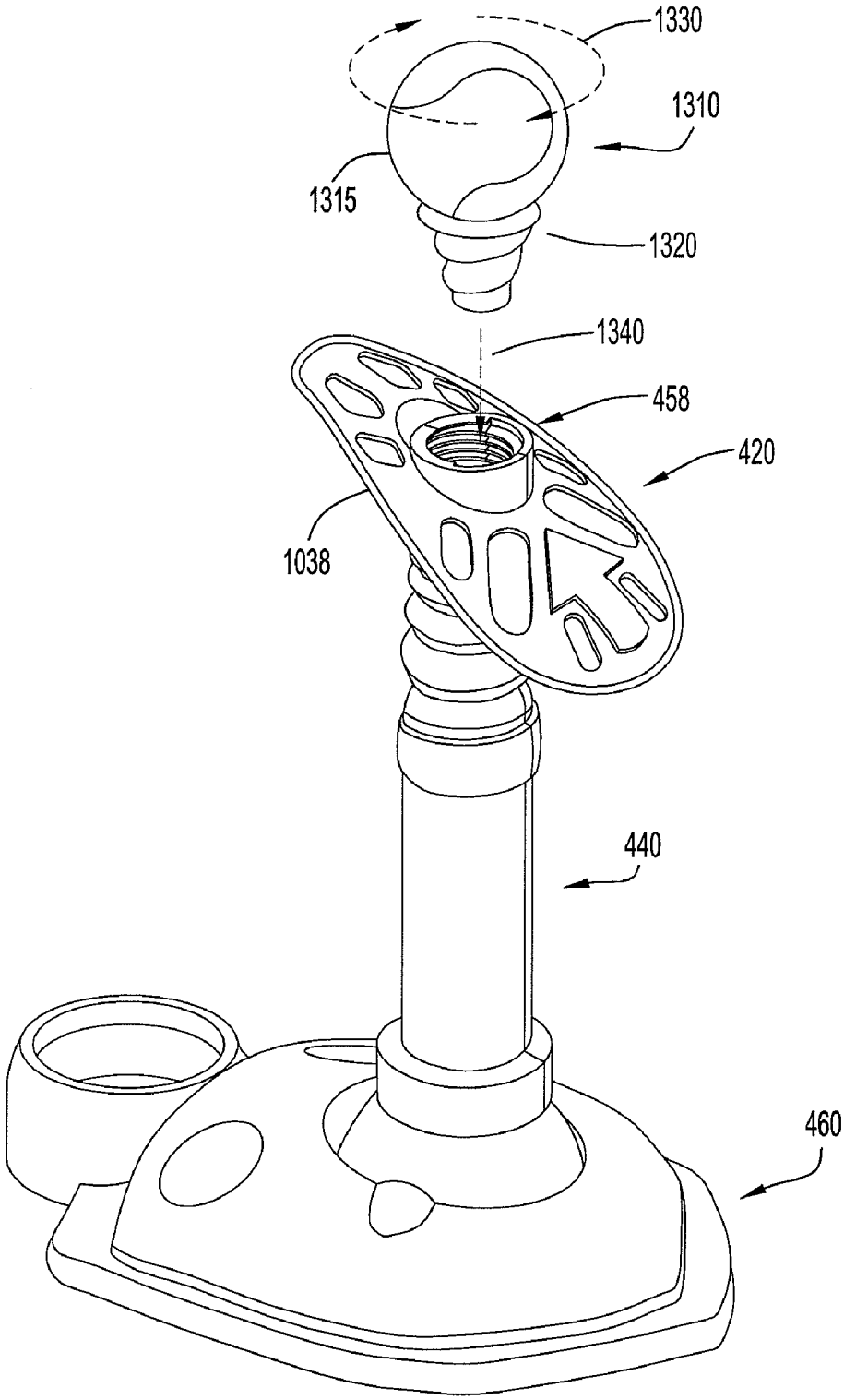
FIG. 13 illustrates a perspective view of the system of FIG. 3. showing a second type of implement being secured to the implement seat.

As discussed above and shown in FIG. 2, the device supports implement 340 above a play surface 10 in a striking position. In the striking position, a child swings a striker 360 (e.g., a bat) and hits the implement 340. FIGS. 12 and 13 illustrate two modes of operation of the device of the present invention. FIG. 12 illustrates a first, unsecured mode, in which the implement 1210 is placed on implement support ring 1038 of implement seat 458 (as illustrated by arrow 1220) in an unrestrained manner. On the other hand, FIG. 13 illustrates a second, secured mode, in which the implement 1310 is secured to implement seat 458. To facilitate these two modes, the implement may comprise two different implement structures. A first implement structure 1210 is employed when the device is operated in the first, unsecured mode, and a second implement structure 1310 is employed when the device is operated in the second, secured mode. First implement structure 1210 has the form illustrated in the embodiment of FIG. 3, which is a defined by generally spherical form 1215. Second implement structure 1310 also has a similar spherical portion 1315. However, second implement structure 1310 includes a threaded extension 1320 for connecting to implement support ring 1038 of implement seat 458.

In the first, unsecured mode, first implement structure 1210 is merely placed onto implement support ring 1038 of implement seat 458 in the direction of arrow 1220. Implement support ring 1038 supports first implement structure 1210 in a stable but unrestrained manner. Therefore, when first implement structure 1210 is placed in the striking position in the first, unsecured mode, a swung bat 360 contacts the implement 1210 and propels the implement 1210 away from implement support (as shown in FIG. 3). In the first, unsecured mode, contact by bat 360 with spherical portion 1215 will generally cause some forward pivoting of positioning member 440 toward pivoted position 320B (see FIG. 3) to absorb the shock of contact with bat 360. The forward pivoting by positioning member 440 is dampened by the biasing member (not shown).

Furthermore, as mentioned above, guide body 421 has an upper portion 424 and a lower portion 422. Upper portion 424 may also be referred to as a second end, a follow-through side, or a distal end. Lower portion 422 may also be referred to as a first end, a swing side, or a proximal end. Upper portion 424 extends above first implement structure 1210 when first implement structure 1210 is positioned on implement seat 458 in the striking position. In the embodiment disclosed in FIG. 3, guide body 421 is positioned so that a bat 360 approaching guide body 421 first arrives at or makes contact with lower portion 422, then makes contact with first implement structure 1210, and finally arrives at or makes contact with upper portion 424. Therefore, when bat 360 makes contact with first implement structure 1210, first implement structure 1210 is propelled over upper portion 424 to ensure a successful upper trajectory of the propelled implement. Thus guide 420 helps to direct the swung striker toward and into proper contact with the implement.

As illustrated in FIG. 13, in the second, secured mode, second implement structure 1310 is secured to implement seat 458 by threadably engaging threaded extension 1320 with threaded opening 1036. The threads are engaged in the direction of arrow 1340 by rotating the implement 1310 in the direction of arrow 1330 until spherical portion 1315 is lowered substantially onto implement support ring 1038. In this manner, second implement structure 1310 cannot be removed from positioning member 440 by mere contact with the striker. Therefore, in the second, secured mode, when spherical portion 1315 is in the striking position and is contacted by a striker, the second implement 1310 remains connected to implement seat 458. As mentioned above, contact with the implement in the second mode causes the positioning member 440 to pivot forward into the pivoted position 320B (see FIG. 3) to absorb the shock of contact with the striker.

Guide 420 may be selectively included or excluded from the device 300. Referring to FIG. 3, guide 420 operates to aid a child in making contact with implement 340 whether the device 300 is being operated in the first mode or in the second mode. When guide 420 is employed in the first, unsecured mode (see FIG. 12), guide 420 aids a child, as discussed above, in making contact with and propelling the implement from the implement support 440. Similarly, when guide 420 is employed in the second, secured mode (see FIG. 13), guide 420 aids a child in making contact with the implement which stays connected to positioning member 440 so the child can swing again without having to retrieve the implement. In the first, unsecured mode, when guide 420 is not employed on implement support 440, implement 340, 1210 can be contacted and propelled from positioning member 440. Similarly, in the second, secured mode the implement 1310 can be contacted, but contact occurs without separation of implement 1310 from positioning member 440.

The device of the present invention allows children of various ages to participate in a range of sporting activities involving striking an implement. Furthermore, the present invention minimizes stress and frustration by young children as they participate in such sporting activities and as they develop their hand-eye coordination skills.

In a different embodiment, the implement may be a sphere (e.g., a ball) attached to implement support 320 by a tether. The tether would limit the distance the ball travels after being struck by the striker making retrieving of the ball easier.

In a different embodiment, guides could be applied above the implement to guide a high swing toward the ball. In addition, upper and lower guides can be employed to direct a high or low swing toward the ball. In addition, the guide may take a different shape. For example, it may extend 360° about the implement support 320 so that a bat may be guided from any swinging direction.

In a different embodiment, positioning member 440 may be supported in a horizontal manner of from another angle other than vertical. As mentioned above with reference to FIG. 10, the positioning member 440 may be a two part telescopic member that allows the implement to be supported at various distances from the play surface 10.

Moreover, this disclosure describes one method of attaching the guide member 420 to the positioning member 440. However, a number of different methods may be employed. The connection may be accomplished by a threaded member on the guide 420 engaging a threaded member on the positioning member 440. In addition, the connection may be made using holes through the guide 420 and positioning member 440 with a connecting pin extending through the holes.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A device for supporting a play implement, the play implement configured to be struck by a swung object, the device comprising:

a base, the base being configured to be disposed on a support surface;

a support member, the support member including a first end and a second end, the first end of the support member being coupled to the base, the second end including a seat configured to engage and support the play implement; and a guide, the guide being coupled to the support member proximate to the seat, the guide including a guide surface that extends laterally beyond the seat and is oriented at an inclined angle with respect to the support member, the guide surface being configured to direct the object swung at the play implement into contact with the play implement on the seat.

2. The device of claim 1, wherein the guide is removably coupled to the support member.

3. The device of claim 2, wherein the guide includes an opening, and the second end of the support member is inserted into the opening.

4. The device of claim 1, wherein the guide includes a first end and a second end, the support member being oriented such that a swing of the object toward the play implement on the seat is proximate to the first end of the guide prior to engaging the play implement and proximate to the second end of the guide after engaging the play implement.

5. The device of claim 4, wherein the guide is coupled to the support member such that the first end of the guide is lower than the second end of the guide.

6. The device of claim 1, wherein the base includes a lower surface that can be disposed in contact with the support surface, and the guide surface is disposed at an angle relative to the lower surface.

7. The device of claim 1, wherein the support member is pivotally coupled to the base, and the support member is telescopically adjustable to vary the elevation of the seat and the guide.

8. A guide for guiding a bat toward a play implement disposed on a support member, the support member including a first end and a second end, the second end including a seat to engage and support the play implement, the guide comprising:

a body, the body defining an opening therein, the opening being configured to receive a portion of the support member, the body including a guide surface that extends laterally beyond the seat when the body is coupled with the support member and is oriented at an inclined angle with respect to the support member, the guide surface being configured to guide the bat toward the play implement; and a coupling mechanism, the coupling mechanism being connected to the body, the coupling mechanism being configured to removably couple the body to the support member and the seat.

9. The guide of claim 8, wherein a portion of the guide surface is disposed below the play implement when the body is coupled to the support member.

10. The guide of claim 8, wherein the body includes a proximal end and a distal end, the proximal end is oriented so that the proximal end is on a side of the play implement that is struck initially by the bat, and the distal end is oriented so that the distal end is on a side of the play implement opposite to the initially struck side of the play implement.

11. The guide of claim 10, wherein the proximal end is lower than the distal end when the body is coupled to the support member.

12. The guide of claim 8, wherein the support member is telescopically adjustable to vary the elevation of the guide.

13. A batting tee, comprising:

a base;

a support, the support including an upper end and a lower end, the lower end of the support being pivotally coupled to the base, the upper end of the support including a seat, the seat being configured to engage and support a ball thereon, the seat having a swing side and a follow-through side; and a guide device that extends laterally beyond the seat and is oriented at an inclined angle with respect to the support, the guide device being configured to be removably coupled to the support and the seat, the guide device being positionable proximate to the upper end of the support, the guide device being oriented such that a portion of the guide device is disposed below the seat on the swing side of the seat.

14. The batting tee of claim 13, wherein the guide device extends outwardly on the swing side of the seat and on the follow-through side of the seat, a portion of the guide device on the swing side of the seat being lower than a portion of the guide device on the follow-through side of the seat.

15. The batting tee of claim 13, wherein the guide device includes an upper portion that extends upward.

16. The batting tee of claim 15, wherein the upper portion guides a propelled ball in an upward direction.

17. The batting tee of claim 13, wherein the support is telescopically adjustable to vary the elevation of the seat and the guide device.

18. The device of claim 1, wherein the guide surface includes a length dimension that is greater than a width dimension of the guide surface, and the guide is positioned with respect to the seat so as to direct the object swung at the play implement along the length dimension of the guide surface and toward the play implement on the seat.

19. The device of claim 1, wherein the guide surface has a convex curvature.

* * * * *